US012389991B1

(12) United States Patent
Zeng

(10) Patent No.: US 12,389,991 B1
(45) Date of Patent: Aug. 19, 2025

(54) HOOK WITH DYNAMIC DISPLAY

(71) Applicant: Xinyu Zheng, Sichuan Province (CN)

(72) Inventor: Dan Zeng, Sichuan (CN)

( * ) Notice: Subject to any disclaimer, the term of this patent is extended or adjusted under 35 U.S.C. 154(b) by 0 days.

(21) Appl. No.: 19/200,750

(22) Filed: May 7, 2025

(30) Foreign Application Priority Data

Apr. 16, 2025 (CN) ..... 202520719926.X

(51) Int. Cl.
*A44C 25/00* (2006.01)

(52) U.S. Cl.
CPC ..... *A44C 25/001* (2013.01)

(58) Field of Classification Search
CPC ..... A44C 25/001
USPC ..... 248/694, 617, 497, 100, 225.21, 304, 248/322.339
See application file for complete search history.

(56) References Cited

U.S. PATENT DOCUMENTS 247,873 A * 10/1881 Bassett ..... A44C 7/00 63/12
2,119,039 A * 5/1938 Boyd ..... A44C 9/00 63/29.1
3,623,193 A * 11/1971 Rikard ..... A44C 1/00 24/545
3,866,035 A * 2/1975 Richey, Jr. ..... A44C 15/0015 362/104
6,250,597 B1 * 6/2001 Kuo ..... A47K 10/10 248/231.91
7,707,722 B1 * 5/2010 Kothari ..... A44C 17/04 63/27
10,349,710 B1 * 7/2019 Talesara ..... A44C 25/001
2009/0148483 A1 * 6/2009 Rashid ..... A61Q 13/00 424/443
2010/0101274 A1 * 4/2010 Worth ..... A63B 57/353 29/896.41
2012/0164483 A1 * 6/2012 Hirama ..... A44C 27/002 428/673
2013/0263627 A1 * 10/2013 Bisserier ..... A44C 9/003 63/15
2013/0319043 A1 * 12/2013 Thomas ..... A44C 7/00 63/3
2017/0112241 A1 * 4/2017 Fukui ..... A44C 17/02
2019/0098968 A1 * 4/2019 Quintero ..... G03B 17/561
2020/0187607 A1 * 6/2020 Law ..... A44C 25/001
2022/0256985 A1 * 8/2022 See ..... A44C 25/002
2023/0052864 A1 * 2/2023 Paumier ..... A44C 13/00

* cited by examiner

*Primary Examiner* — Muhammad Ijaz
(74) *Attorney, Agent, or Firm* — Sang Young Han

(57) ABSTRACT

A hook with dynamic display is provided, including a housing; a rotary disc, sleeved on the rotating shaft, and the rotary disc is provided with a gear thereon; rotatable petals, arranged obliquely on the rotary disc and extend to the slots; a draw hook, provided with a guide slot on one end thereon, and a rack is provided on one side of the guide slot, the rack is engaged with the gear; and springs, arranged in the sliding slots. Another end of the draw hook provided at the exterior of the housing is configured to move under an external force to engage the rack with the gear for transmission, and the rotary disc is configured to rotate and drive the rotatable petals to extend out from the slots. The hook has a dynamic display effect, enhancing the fun of product.

4 Claims, 6 Drawing Sheets

HOOK WITH DYNAMIC DISPLAY

CROSS REFERENCE TO RELATED APPLICATION

This application claims priority to Chinese Patent Application No. CN 202520719926.X, entitled "hook with dynamic display", filed on Apr. 16, 2025, which is hereby incorporated by reference in its entirety.

TECHNICAL FIELD

The present disclosure relates to the technical field of pendants, and in particular to a hook with dynamic display.

BACKGROUND

Traditional decorative hooks usually adopt static design, relying on fixed shapes or simple swinging structures to achieve decorative effects. Although some products attempt to achieve dynamic display through mechanical linkage or electric drive, there are still the following issues.

Complex structure: pendants driven by electric or springs require additional power devices (such as motors, batteries, etc.), resulting in increased volume, higher costs, and inconvenient maintenance.

Lack of interactivity: most dynamic pendants have a single action mode (such as one-way rotation or swinging), lacking user interaction and making it difficult to attract user participation.

Therefore, improvements need to be made in this regard.

SUMMARY

In view of the deficiencies in existing technologies, the present disclosure aims to provide a hook with dynamic display to address the problems raised in the background.

To achieve the above objectives, the present disclosure adopts the following technical solutions. In some embodiments of the present disclosure, a hook with dynamic display is provided, including a housing, a rotary disc, rotatable petals, a draw hook, and springs.

Herein the housing includes a front housing, connecting strips, and a rear housing. The connecting strips are uniformly arranged at circumferential edges of the front housing and the rear housing, and adjacent connecting strips form slots with the front housing and the rear housing. The front housing and the connecting strips with the rear housing are configured to form an installation space, and a rotating shaft is disposed within the installation space. A side wall of the rear housing facing the installation space is provided with longitudinally spaced sliding slots, and first positioning columns are provided at lower parts of the sliding slots.

Herein the rotary disc is sleeved on the rotating shaft, and the rotary disc is provided with a gear at a center therein.

Herein the rotatable petals are provided with one or more, the rotatable petals are arranged obliquely on a circumferential edge of the rotary disc, the rotatable petals are movably connected to the rotary disc and extend to the slots.

Herein the draw hook is provided with a guide slot on one end thereon. A rack is provided within the guide slot, and the rack is engaged with the gear for transmission. Both sides of the guide slot are respectively provided with second positioning columns extending to the sliding slots, and the second positioning columns are arranged corresponding to the first positioning columns. A hook portion of the draw hook is provided at an exterior of the housing.

Herein the springs are arranged in the sliding slots, and the springs are respectively connected to the first positioning columns and the second positioning columns.

Herein another end of the draw hook provided at the exterior of the housing is configured to move under an external force to engage the rack with the gear for transmission, and the rotary disc is configured to rotate and drive the rotatable petals to extend from the slots; and when the external force is removed, the springs are configured to drive the draw hook for resetting, causing the rotary disc to rotate and retract the rotatable petals from the slots.

In some preferred embodiments of the present disclosure, mounting ports distributed in a circular array are provided on at least one end plane of the rotary disc, and the rotatable petals are movably placed within the mounting ports.

In some preferred embodiments of the present disclosure, mounting ports distributed in the circular array are provided on end planes of both sides of the rotary disc, the rotatable petals are movably placed within the mounting ports, and the rotatable petals on both sides of the rotary disc are arranged in a staggered manner.

In some preferred embodiments of the present disclosure, expanded rotatable petals are matched with the housing to form a flower style.

Compared with the existing technologies, the hook with dynamic display of the present disclosure has at least the following beneficial effects.

Dynamic display effect: driving the gear-rack transmission by a linear motion of the draw hook, which can drive the rotary disc to rotate and extend the petals from the slots, creating a dynamic effect of "flower blooming". Such mechanical linkage structure can convert users' simple pulling actions into synchronized unfolding of petals, thereby enhancing the fun and interactivity of the product.

Space optimization design: the combination of the slots and the connecting strips can enable the housing to have both structural support and petal guidance functions. The staggered installation and tilted setting of petals can achieve a multi-layered three-dimensional display effect, enhancing the visual hierarchy in a limited space.

New structural design: organically combining the mechanical transmission with the decorative functions, generating complex rotating and unfolding movements through simple linear operations, not only enhancing ornamental value but also maintaining structural simplicity, making it suitable for multi-scenario applications such as gift decoration and commercial displays.

Figure 1:
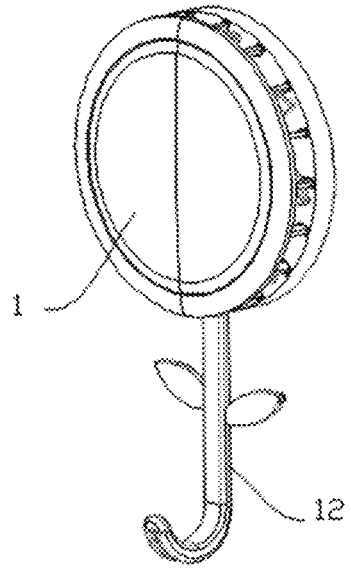
FIG. 1 shows a structural schematic diagram of a hook with dynamic display when rotatable petals are retracted in accordance with some embodiments of the present disclosure.
Figure 2:
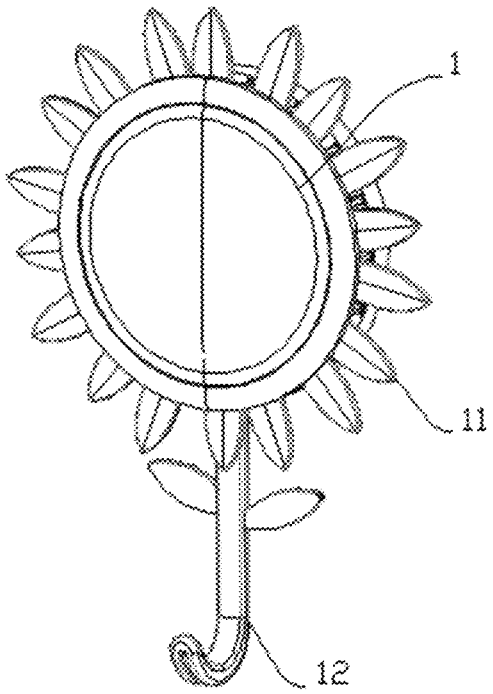
FIG. 2 shows a structural schematic diagram of the hook with dynamic display when the rotatable petals are unfolded in accordance with some embodiments of the present disclosure.
Figure 3:
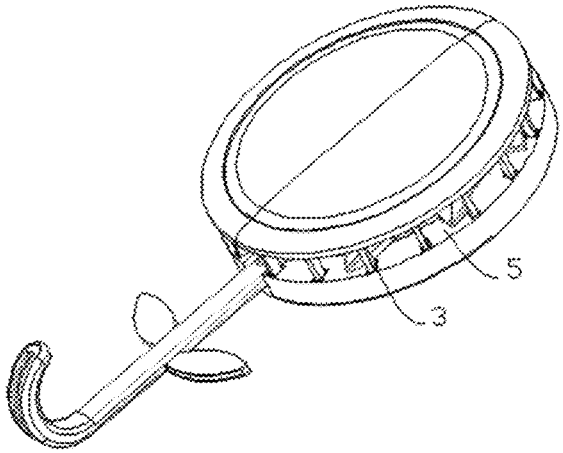
FIG. 3 shows a structural schematic diagram from another angle of FIG. 1.
Figure 4:
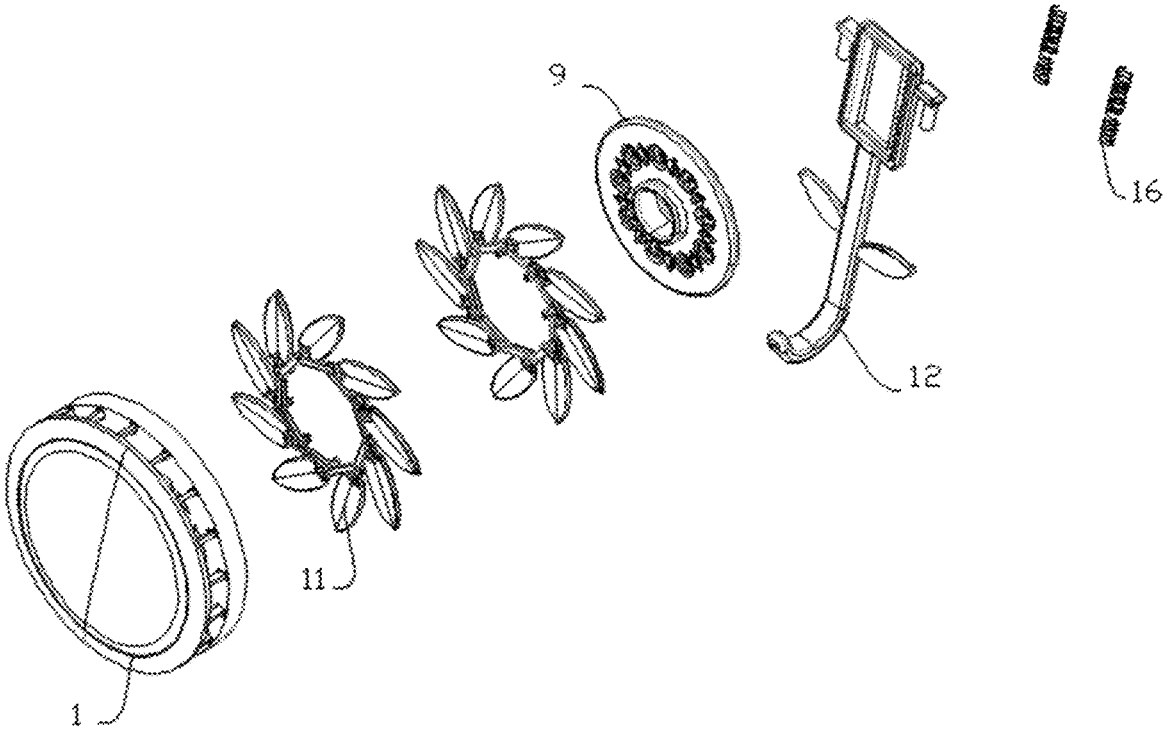
FIG. 4 shows an exploded view of the hook with dynamic display when the rotatable petals are retracted in accordance with some embodiments of the present disclosure.
Figure 5:
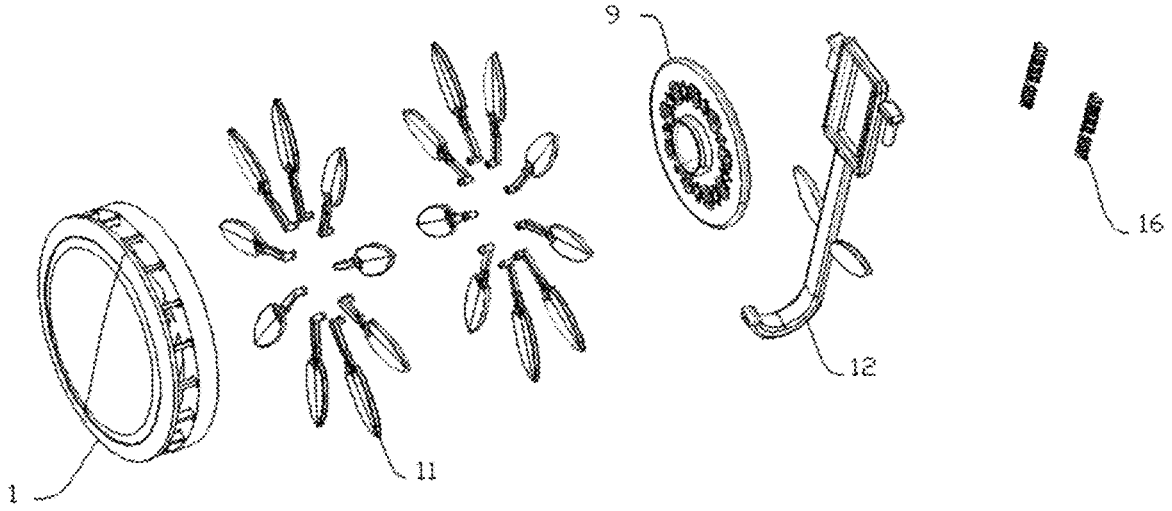
FIG. 5 shows an exploded view of the hook with dynamic display when the rotatable petals are unfolded in accordance with some embodiments of the present disclosure.
Figure 6:
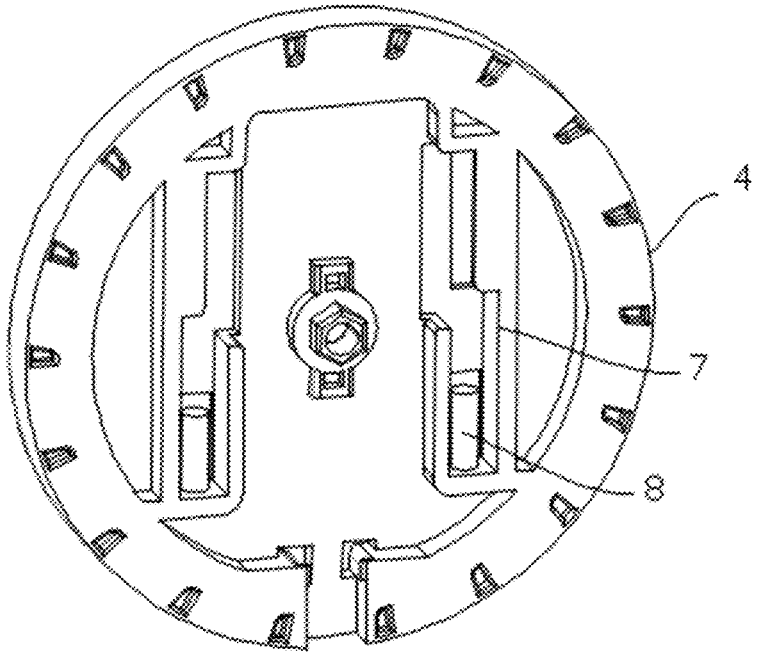
FIG. 6 shows a structural schematic diagram of a rear housing in accordance with some embodiments of the present disclosure.
Figure 7:
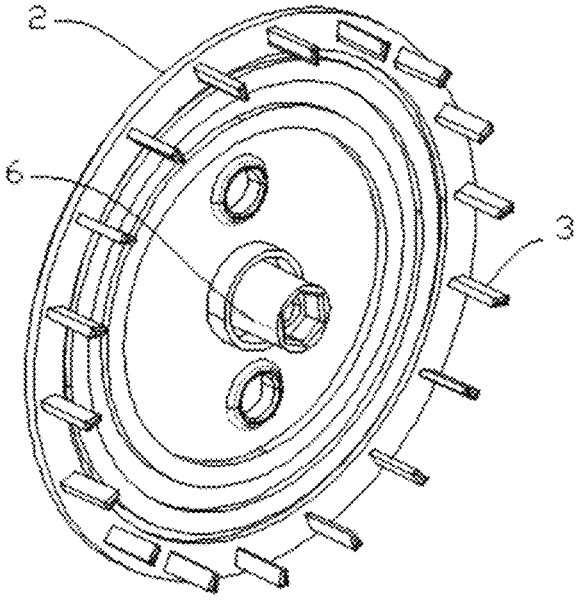
FIG. 7 shows a structural schematic diagram of a front housing in accordance with some embodiments of the present disclosure.
Figure 8:
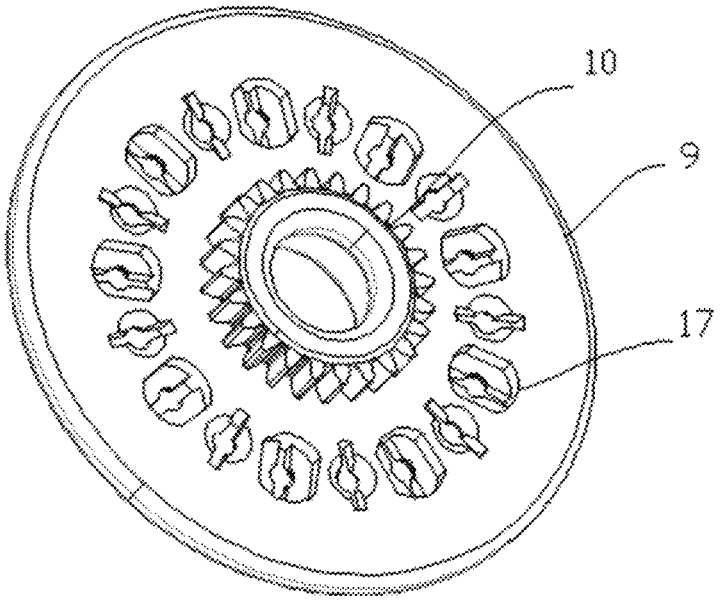
FIG. 8 shows a structural schematic diagram of a rotary disc in accordance with some embodiments of the present disclosure.
Figure 9:
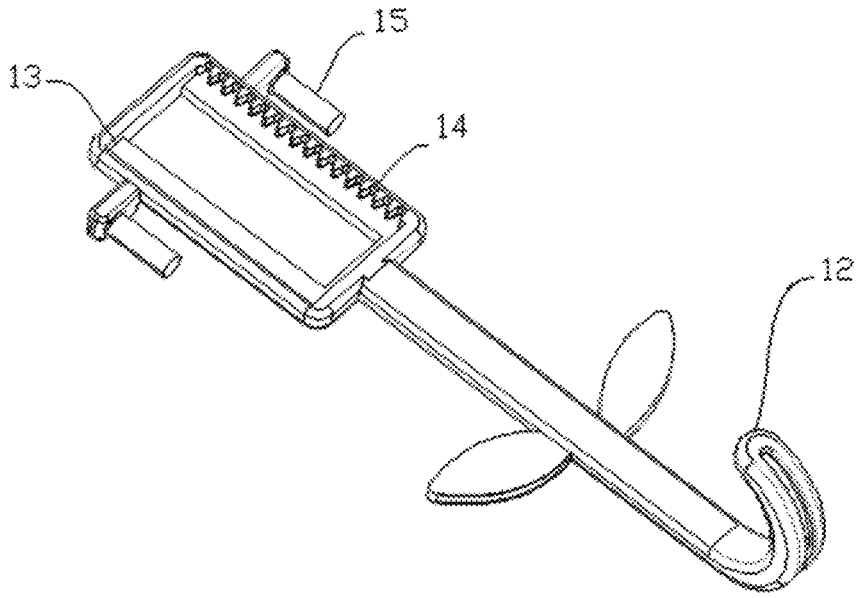
FIG. 9 shows a structural schematic diagram of a draw hook in accordance with some embodiments of the present disclosure.

In the drawings, reference numerals are as follows. 1. Housing, 2. Front housing, 3. Connecting strip, 4. Rear housing, 5. Slot, 6. Rotating shaft, 7. Sliding slot, 8. First positioning column, 9. Rotary disc, 10. Gear, 11. Rotatable petal, 12. Draw hook, 13. Guide slot, 14. Rack, 15. Second positioning column, 16. Spring, 17. Mounting port.

DETAILED DESCRIPTION OF THE EMBODIMENTS

The following will provide further detailed explanations of the hook with dynamic display of the present disclosure in conjunction with the accompanying drawings.

Given the technical issues raised in the background, as shown in FIG. 1 to FIG. 12, in some embodiments of the present disclosure, a hook with dynamic display is provided, including a housing 1, a rotary disc 9, rotatable petals 9, a draw hook 12, and springs 16.

Herein the housing 1 includes a front housing 2, connecting strips 3, and a rear housing 4. The connecting strips 3 are uniformly arranged at circumferential edges of the front housing 2 and the rear housing 4, and adjacent connecting strips 3 form slots 5 with the front housing 2 and the rear housing 4. The front housing 2 and the connecting strips 3 with the rear housing 4 are configured to form an installation space, and a rotating shaft 6 is disposed within the installation space. A side wall of the rear housing 4 facing the installation space is provided with longitudinally spaced sliding slots 7, and first positioning columns 8 are provided at lower parts of the sliding slots 7.

Herein the rotary disc 9 is sleeved on the rotating shaft 6, and the rotary disc 9 is provided with a gear 10 at a center therein.

Herein the rotatable petals 11 are provided with one or more, the rotatable petals 11 are arranged obliquely on a circumferential edge of the rotary disc 9, the rotatable petals 11 are movably connected to the rotary disc 9 and extend to the slots 5.

Herein the draw hook 12 is provided with a guide slot 13 on one end thereon. A rack 14 is provided within the guide slot 13, and the rack 14 is engaged with the gear 10 for transmission. Both sides of the guide slot 13 are respectively provided with second positioning columns 15 extending to the sliding slots 7, and the second positioning columns 15 are arranged corresponding to the first positioning columns 8. A hook portion of the draw hook 12 is provided at an exterior of the housing 1.

Herein the springs 16 are arranged in the sliding slots 7, and the springs 16 are respectively connected to the first positioning columns 8 and the second positioning columns 15.

Herein another end of the draw hook 12 provided at the exterior of the housing 1 is configured to move under an external force to engage the rack 14 with the gear 10 for transmission, and the rotary disc 9 is configured to rotate and drive the rotatable petals 11 to extend from the slots 5; and when the external force is removed, the springs 16 are configured to drive the draw hook 12 for resetting, causing the rotary disc 9 to rotate and retract the rotatable petals 11 from the slots 5.

In some embodiments of the present disclosure, the housing 1 may be designed in other styles such as round or flower shaped. Alternatively, in some embodiments, the housing 1 will be designed in round, and the internal space of the housing 1 will be set as an accommodation space according to the required installation components. For example, the internal space of the housing 1 is mainly used to install the rotary disc 9, the rotatable petals 11 and the draw hook 12. The housing 1 consists of the front housing 2, the connecting strips 3 and the rear housing 4. The connecting strips 3 are disposed between the front housing 2 and the rear housing 4, and the connecting strips are distributed in a circular array at the circumferential edges of the front housing 2 and the rear housing 4. Adjacent connecting strips 3 form slots 5 with the front housing 2 and the rear housing 4, to guide the extension and retraction of petals. Sliding slots 7 are provided on the inner wall of the rear housing 4, and the sliding slots 7 are arranged on left and right to accommodate the springs 16, the first positioning columns 8 and the second positioning columns 15.

The rotary disc 9 can be flexibly installed within the housing 1, meaning it can rotate within the housing 1. Specifically, the rotating shaft 6 can be set within the housing 1, and the rotary disc 9 is sleeved on the rotating shaft 6, to achieve rotation within the housing 1.

The number of the rotatable petals 11 can be set according to actual usage needs, and there is no limit herein.

As a driving component, the draw hook 12 is provided with a guide slot 13 at one end thereon, and a rack 14 is provided within the guide slot 13. The rack 14 is engaged with the gear 10 to form a transmission mechanism. The structure of the guide slot 13 can guide the draw hook 12 and improve structural stability. Both ends of the guide slot are provided with second positioning columns 15, which can cooperate with the first positioning columns 8 of the sliding slots 7 for fixing installation of the springs 16. At the same time, the movement of the second positioning columns 15 within the sliding slots 7 is coordinated with the guide slot 13 of the draw hook 12, forming a dual guidance and also guiding the movement of the draw hook 12, resulting in a more stable motion.

The specific usage process is as follows. When a user lightly pulls down the draw hook 12, the second positioning columns 15 provided on the both sides of the draw hook 12 move within the sliding slots 7. The second positioning columns 15 compresses the spring 16, while the rack 14 drives the gear 10 to rotate, causing the rotary disc 9 to rotate. Due to the tilted installation of the rotatable petals 11 on the rotary disc 9, the rotation of the rotary disc 9 will drive the rotatable petals 11 to expand outward from the slots 5, creating a dynamic effect of blooming flowers. When the draw hook 12 is released, under the elastic force of the springs 16, the springs 16 drive the draw hook 12 to move in an opposite direction, and the rack 14 of the draw hook 12 drives the rotary disc 9 to reverse, causing the petals to retract and return to their initial state.

By driving the gear 10-rack 14 transmission through the linear motion of the draw hook 12, the rotary disk 9 is driven to rotate and then the petals are extended from the slots 5, creating the dynamic effect of "flower blooming". This mechanical linkage structure converts user's simple pulling action into synchronized unfolding of petals, enhancing the fun and interactivity of the product. The combination design of the slots 5 and the connecting strips 3 enables the housing 1 to have both structural support and petal guidance functions. Moreover, this product organically combines mechanical transmission with decorative functions, generating complex rotating and unfolding movements through simple linear operations. Thus, it can enhance the viewing experience while maintaining the simplicity of the structure, and is suitable for various scenarios such as gift decoration and commercial displays.

Figure 10:
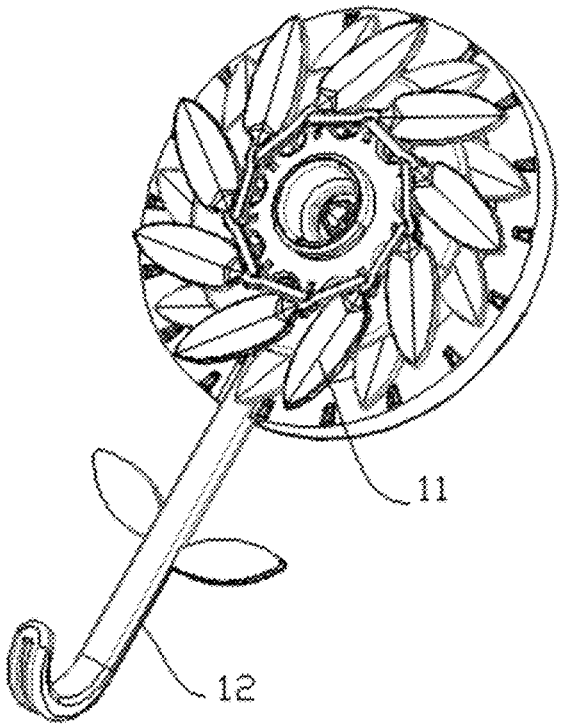
FIG. 10 shows a structural schematic diagram of the rotary disc and the draw hook in accordance with some embodiments of the present disclosure.
Figure 11:
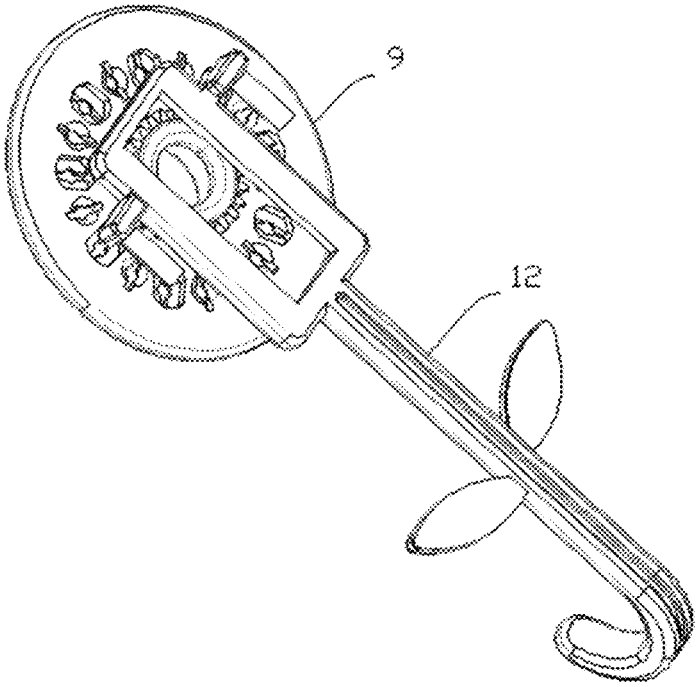
FIG. 11 shows another structural schematic diagram of the rotary disc and the draw hook in accordance with some embodiments of the present disclosure.
Figure 12:
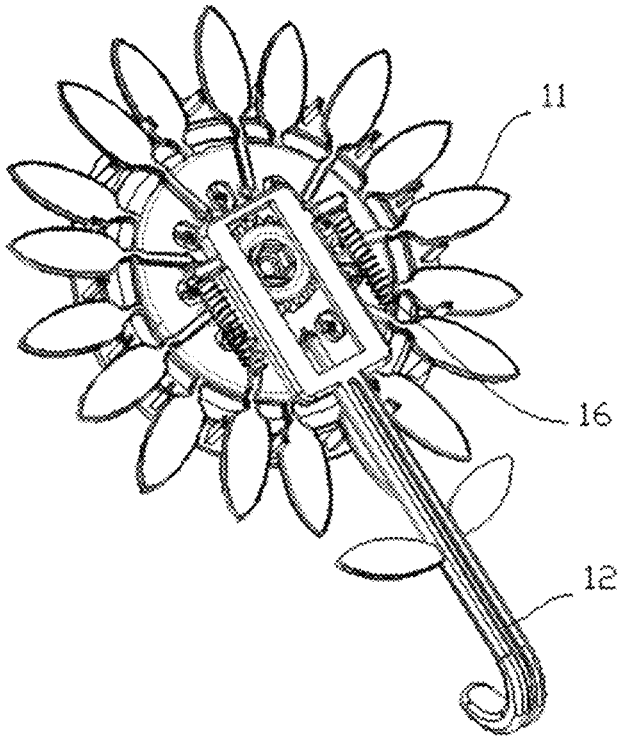
FIG. 12 shows an internal structure schematic diagram of the hook with dynamic display when the rotatable petals are unfolded in accordance with some embodiments of the present disclosure.

Referring to FIG. 10 and FIG. 12, in some embodiments, mounting ports 17 are provided on at least one end plane of the rotary disc 9, and the rotatable petals 11 are movably placed within the mounting ports 17.

In some other embodiments, the mounting ports 17 distributed in a circular array may be provided on one end plane of the rotary disc 9, and the number of the mounting ports 17 can be set according to the actual required rotatable petals 11. In some another embodiments, mounting ports 17 distributed in the circular array are disposed on end planes of both sides of the rotary disc 9, the rotatable petals 11 are movably placed within the mounting ports 17, and the rotatable petals 11 on both sides of the rotary disc 9 are arranged in a staggered manner, for example, the rotatable petals are disposed on opposite sides but do not overlap radially. Preferably, in one embodiment, the latter implementation is adopted. When using the latter implementation, the mounting ports 17 on both sides of the rotary disc 9 can be staggered in distribution, which can make the unfolded rotatable petals 11 dense.

Preferably, the unfolded rotatable petals 11 are combined with the housing 1 to form a floral pattern. Of course, other styles can also be used, which will not be described herein.

The above does not limit the technical scope of the hook with dynamic display of the present disclosure in any way. Any modifications, equivalent changes, and modifications made to the above embodiments based on the technical essence of the present disclosure shall fall within the scope of the technical solutions of the present invention.

What is claimed is:

1. A hook with dynamic display, comprising:

a housing, comprising a front housing, connecting strips, and a rear housing;

wherein the connecting strips are uniformly arranged at circumferential edges of the front housing and the rear housing, and adjacent strips of said connecting strips form slots with the front housing and the rear housing;

wherein the front housing and the connecting strips with the rear housing are configured to form an installation space, and a rotating shaft is disposed within the installation space; and wherein a side wall of the rear housing facing the installation space is provided with longitudinally spaced sliding slots, and first positioning columns are provided at lower parts of the sliding slots;

a rotary disc, sleeved on the rotating shaft, and the rotary disc is provided with a gear at a center therein;

one or more rotatable petals wherein the rotatable petals are arranged obliquely on a circumferential edge of the rotary disc, the rotatable petals are movably connected to the rotary disc and extend to the slots;

a draw hook, provided with a guide slot on one end thereon;

wherein a rack is provided within the guide slot, and the rack is engaged with the gear for transmission;

wherein both sides of the guide slot are respectively provided with second positioning columns extending to the sliding slots, and the second positioning columns are arranged corresponding to the first positioning columns; and wherein a hook portion of the draw hook is provided at an exterior of the housing; and springs, arranged in the sliding slots, wherein the springs are respectively connected to the first positioning columns and the second positioning columns; and wherein another end of the draw hook provided at the exterior of the housing is configured to move under an external force to engage the rack with the gear for transmission, and the rotary disc is configured to rotate and drive the rotatable petals to extend from the slots; and when the external force is removed, the springs are configured to drive the draw hook for resetting, causing the rotary disc to rotate and retract the rotatable petals from the slots.

2. The hook with dynamic display according to claim 1, wherein mounting ports distributed in a circular array are provided on at least one end plane of the rotary disc, and the rotatable petals are movably placed within the mounting ports.

3. The hook with dynamic display according to claim 1, wherein mounting ports distributed in a circular array are provided on end planes of both sides of the rotary disc, the rotatable petals are movably placed within the mounting ports, and the rotatable petals on both sides of the rotary disc are arranged in a staggered manner.

4. The hook with dynamic display according to claim 1, wherein expanded rotatable petals are combined with the housing to form a flower style.

* * * * *